United States Patent [19]

Fukutomi et al.

[11] Patent Number: 4,892,078

[45] Date of Patent: Jan. 9, 1990

[54] FUEL SUPPLY QUANTITY CONTROL METHOD FOR INTERNAL COMBUSTION ENGINE

[75] Inventors: Yoji Fukutomi; Takeshi Fukuzawa, both of Utsunomiya; Keisuke Kudo, Tochigi, all of Japan

[73] Assignee: Honda Giken Kogyo Kabushiki Kaisha, Tokyo, Japan

[21] Appl. No.: 242,002

[22] Filed: Sep. 8, 1988

[30] Foreign Application Priority Data

Sep. 8, 1987 [JP] Japan ..... 62-224967

[51] Int. Cl.[4] ..... F02D 41/14

[52] U.S. Cl. ..... 123/489; 123/491; 123/492

[58] Field of Search ..... 123/489, 491, 492

[56] References Cited

U.S. PATENT DOCUMENTS

| | | | |
|---|---|---|---|
| 4,494,512 | 1/1985 | Kishi et al. | 123/489 |
| 4,589,390 | 5/1986 | Wazaki et al. | 123/489 |
| 4,753,208 | 6/1988 | Yamato et al. | 123/489 |

FOREIGN PATENT DOCUMENTS 62-126236 6/1987 Japan .

*Primary Examiner*—Andrew M. Dolinar

*Attorney, Agent, or Firm*—Pollock, Vande Sande & Priddy

[57] ABSTRACT

To control the quantity of fuel supplied to an I.C. engine, a sensor generates an exhaust gas component concentration signal. If the present fuel supply quantity does not exceed a reference quantity, the fuel supply is set according to engine operation parameters. If the preset quantity is greater than the reference quantity for a predetermined reference time, the fuel supply is set without regard to the signal. The reference time is changed as a function of engine temperature.

3 Claims, 3 Drawing Sheets

FUEL SUPPLY QUANTITY CONTROL METHOD FOR INTERNAL COMBUSTION ENGINE

FIELD OF THE INVENTION

The present invention relates to a fuel supply quantity control method for an internal combustion engine.

BACKGROUND OF THE INVENTION

In a known method of controlling a fuel supply quantity for the purpose of properly supplying fuel to an internal combustion engine, a basic supply quantity is determined according to a basic engine operation parameter, such as pressure in an intake pipe, in synchronism with engine speed, and the basic supply quantity so determined is corrected, i.e., increased or decreased, according to an additional engine operation parameter such as engine cooling water temperature or a transitional change of the engine, thereby determining a fuel supply quantity. A fuel supply device such as an injector is then operated for a period of time corresponding to this fuel supply quantity to thereby control the fuel quantity to be supplied to the engine.

In the prior art, when a three-way catalyst is provided in an exhaust system so as to purify an exhaust gas, the three-way catalyst is operated most effectively at an air-fuel ratio of a fuel mixture near a theoretical air-fuel ratio (14.7, for example). Therefore, the air-fuel ratio of the fuel mixture is usually feedback controlled to the theoretical air-fuel ratio, by detecting an exhaust gas component concentration, such as an oxygen concentration in the exhaust gas, as one of the engine operation parameters, by means of an exhaust gas component concentration sensor, and correcting the basic supply quantity according to an output signal from such sensor.

Such an air-fuel ratio feedback control is not always carried out, but may be stopped under specific operational conditions of the engine, such as low cooling water temperature or high engine load, so as to improve the operational condition. Instead, an open-loop control is carried out irrespective of the output signal from the exhaust gas component concentration sensor, so that the air-fuel ratio may be enriched.

Further, in the above-described method, the fuel supply quantity is increased under a high engine load to enrich the air-fuel ratio. It is undesirable to carry out the air-fuel ratio feedback control when increasing the fuel quantity. There is disclosed in U.S. Pat. No. 4,494,512 a control method wherein a high engine load is determined when the fuel supply quantity becomes greater than a predetermined quantity, and the open-loop control is substituted for the air-fuel ratio control.

However, the above-described control method has the drawback that the exhaust quantity of CO (carbon monoxide) . is temporarily increased to reduce the exhaust gas purification rate. To prevent such an increase in the exhaust quantity of CO, it is proposed in Japanese Patent Publication No. 62-126236 that the timing of the shift from the air-fuel ratio feedback control to the open-loop control is delayed for a predetermined time after the fuel supply quantity exceeds the predetermined quantity. However, since the combustion condition of the engine at a low engine temperature is unstable, it is desirable to quickly enrich the air-fuel ratio. For this reason, applicant has determined that the time delay in shifting the feedback control to the openloop control is preferably variable.

SUMMARY OF THE INVENTION

Accordingly, it is an object of the present invention to provide a fuel supply quantity control method for an internal combustion engine which permits a smooth shift to a high engine load operation irrespective of engine temperature.

The method according to the invention provides, in a method of controlling a fuel supply quantity with use of a fuel supply device in an internal combustion engine having an exhaust gas component concentration sensor for generating an exhaust gas component signal, the steps of setting the fuel supply quantity according to engine operation parameters including the exhaust gas component signal so far as a preset fuel supply quantity is not greater than a reference quantity, setting the fuel supply quantity irrespective of the exhaust gas component signal when the preset fuel supply quantity continues to be greater than the reference quantity for at least a reference time, and changing the reference time according to engine temperature.

BRIEF DESCRIPTION OF THE DRAWING

In order that the invention may be more clearly understood, reference will now be made to the accompanying drawings, wherein an embodiment of the invention is shown for purposes of illustration, and wherein.

DESCRIPTION OF PREFERRED EMBODIMENT

Figure 1:
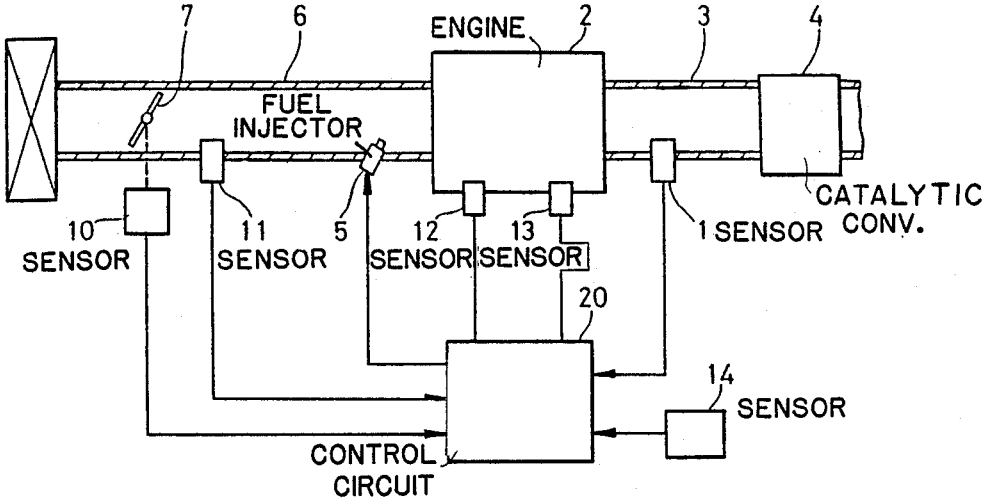
FIG. 1 is a schematic illustration of the electronically controlled fuel injection supply device to which the fuel supply quantity control method of the present invention is applied.

FIG. 1 shows an electronically controlled fuel injection supply device to which the fuel supply quantity control method of the present invention is applied. The electronically controlled fuel injection supply device is provided with an oxygen concentration sensor 1 serving as an exhaust gas component concentration sensor adapted to generate an output voltage according to the oxygen concentration in the exhaust gas. The sensor 1 is located upstream of a three-way catalytic converter 4 in the exhaust pipe 3 of engine 2. The sensor 1 is a $\lambda=1$ type sensor, for example, designed to suddenly change an output voltage at a theoretical air-fuel ratio. An injector 5 for injecting fuel is provided in an intake pipe 6 at a position in the vicinity of intake valves (not shown) of the engine 2.

A throttle valve opening sensor 10 such as a potentiometer is provided to generate an output voltage according to an opening angle of a throttle valve 7 in the intake pipe 6. An absolute pressure sensor 11 is provided in the intake pipe 6 to generate an output voltage at a level according to an absolute pressure $P_{BA}$ in the intake pipe 6. A crank angle sensor 12 is provided to generate a pulse, e.g., a TDC pulse, synchronous with the rotation of a crankshaft (not shown) of the engine 2. A cooling water temperature sensor 13 is provided to generate an output voltage at a level according to a cooling water temperature $T_W$ of the engine 2. Each output from the oxygen concentration sensor 1, the throttle valve opening sensor 10, the absolute pressure sensor 11, the crank angle sensor 12 and the cooling water temperature sensor 13 is supplied to a control circuit 20. An atmospheric pressure sensor 14 for generating an output at a level according to an atmospheric pressure is connected to the control circuit 20.

Figure 2:
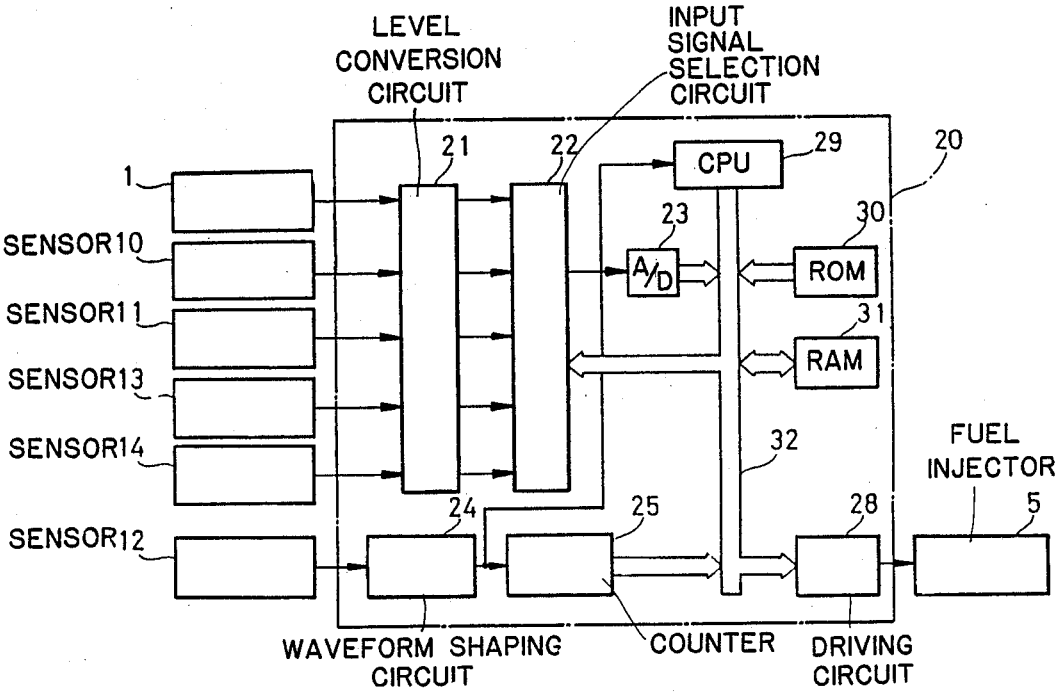
FIG. 2 is a block diagram of the control circuit in the device shown in FIG. 1.

Referring to FIG. 2, the control circuit 20 includes a level conversion circuit 21 for converting a level of each output from the oxygen concentration sensor 1, the throttle valve opening sensor 10, the absolute pressure sensor 11, the cooling water temperature sensor 13 and the atmospheric pressure sensor 14, an input signal selection circuit 22 for selectively generating one of the sensor outputs received through the level conversion circuit 21, an A/D converter 23 for converting an output signal from the input signal selection circuit 22 to a digital signal, a waveform shaping circuit 24 for shaping a waveform of the output signal from the crank angle sensor 12, a counter 25 for measuring a pulse separation of output pulses from the waveform shaping circuit 24 by the number of clock pulses generated from a clock pulse generating circuit (not shown) and outputting data of an engine speed $N_e$, a driving circuit 28 for driving the injector 5, a CPU (central processing unit) 29 for conducting a digital operation according to a program, a ROM 30 for preliminarily storing various processing programs and data, and a non-volatile RAM 31. The input signal selection circuit 22, the A/D converter 23, the counter 25, the driving circuit 28, the CPU 29, the ROM 30 and the RAM 31 are connected together through an I/O bus 32. A TDC pulse signal from the waveform shaping circuit 24 is supplied to the CPU 29. The CPU 29 incorporates timers A and B (both not shown).

Each information relative to throttle valve opening $\theta_{th}$, absolute pressure $P_{BA}$ in the intake pipe 6, cooling water temperature $T_W$, oxygen concentration $O_2$ in the exhaust gas and atmospheric pressure $P_A$ is alternatively supplied through the I/O bus 32 into the CPU 29. The CPU 29 reads the information items according to the operation program stored in the ROM 30, and computes a fuel injection time $T_{OUT}$ of the injector 5 corresponding to a fuel quantity to be supplied to the engine 2 in accordance with a predetermined arithmetic expression, in synchronism with the TDC pulse signal on the basis of the above units of information. The driving circuit 28 then drives the injector 5 by the fuel injection time $T_{OUT}$ to supply the fuel to the engine 2.

The fuel injection time $T_{OUT}$ is calculated from the following expression, for example:

$$T_{OUT}=Ti\times K_{02}\times K_{WOT}\times K_{TW} \quad (1)$$

wherein $T_i$ stands for a basic injection time corresponding to a basic supply quantity to be determined from the engine speed $N_e$ and the absolute pressure $P_{BA}$ in the intake pipe; $K_{02}$ stands for an air-fuel ratio feedback correction factor; $K_{WOT}$ stands for a fuel increase correction factor upon full opening of the throttle valve 7; $K_{TW}$ stands for a cooling water temperature correction factor. The correction factors $K_{02}$, $K_{WOT}$ and $K_{TW}$ are set in a subroutine of a routine for calculating the fuel injection time $T_{OUT}$.

Figure 3:
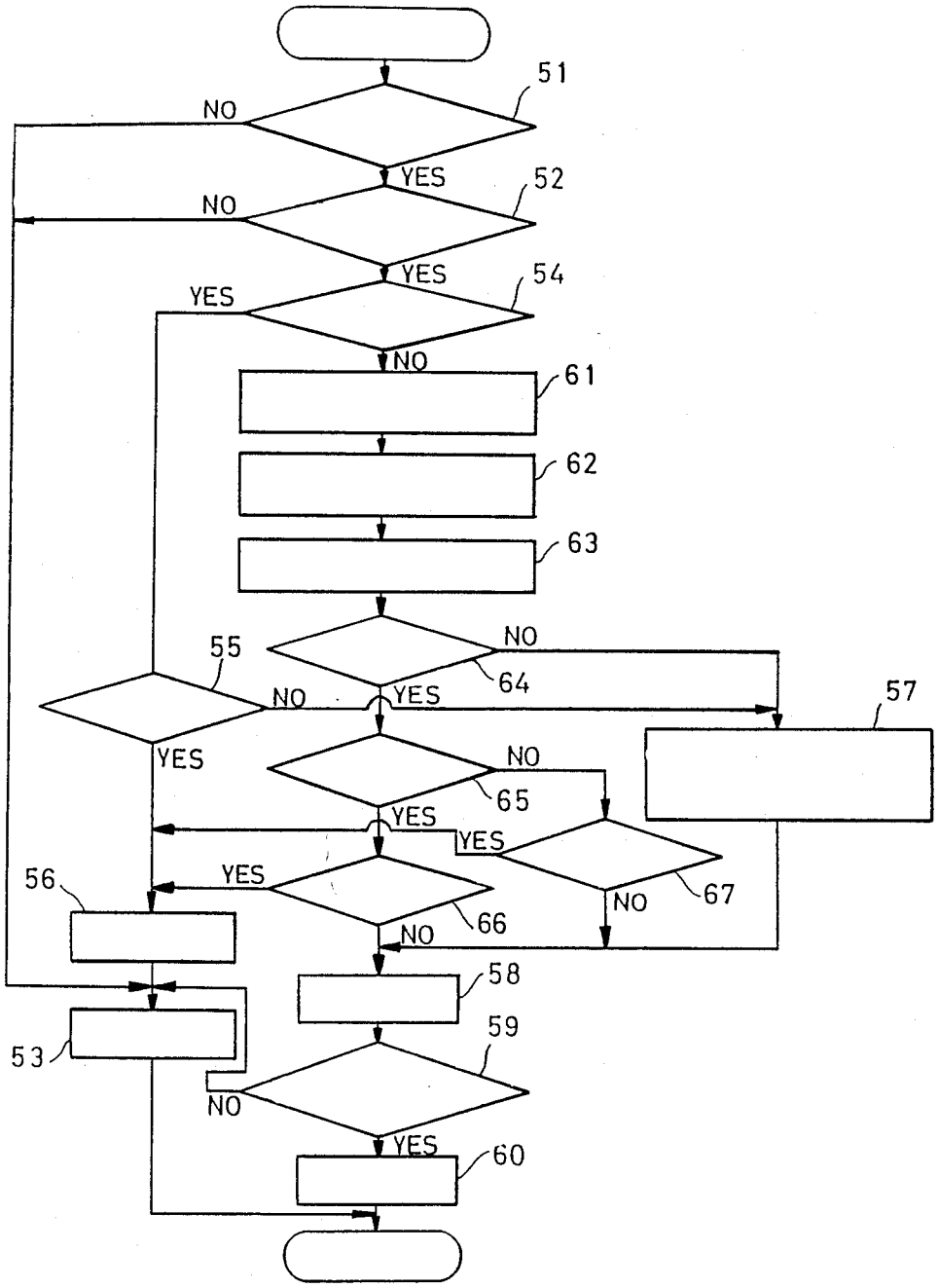
FIG. 3 is a low chart of the operation of the CPU in the control circuit.

There will now be described a procedure of the air-fuel ratio control method of the present invention to be executed by the CPU 29 in the control circuit 20, in accordance with a $K_{02}$ subroutine as shown in FIG. 3.

Referring to FIG. 3, the CPU 29 first determines whether or not activation of the oxygen concentration sensor 1 has been completed (step 51). As the oxygen concentration sensor 1 is warmed up in the lean atmosphere, an output voltage $V_{02}$ of the oxygen concentration sensor 1 changes in such a manner that it once increases to a value not less than a predetermined voltage $V_X$ and then decreases to a value not greater than the predetermined voltage $V_X$. Accordingly, when it is detected that the output voltage $V_{02}$ has become smaller than the predetermined voltage $V_X$, the CPU 29 determines that the activation of the oxygen concentration sensor 1 has been completed. After completion of the activation of the oxygen concentration sensor 1, it is determined whether or not a predetermined time $t_X$ (60 sec, for example) has elapsed from the time of completion of the activation (step 52). If the oxygen concentration sensor 1 remains inactive, or the predetermined time $t_X$ has not yet elapsed from the activation completion time, the present feedback correction factor $K_{02}$ is set to 1.0 so as to open-loop control an air-fuel ratio (step 53). On the other hand, if the predetermined time $t_X$ has elapsed from the activation completion time of the oxygen concentration sensor 1, the throttle valve opening $\theta_{th}$ is read, and it is determined whether or not the throttle valve opening $\theta_{th}$ read is greater than a predetermined opening $\theta_{WOTO}$ (40°, for example) (step 54). If $\theta_{th}>\theta_{WOTO}$, it is determined that the opening angle of the throttle valve 7 is large. Therefore, it is determined whether or not a fuel injection time $T_{OUT}$ in the previous processing cycle is greater than a reference value $T_{WOTO}$ (2 msec, for example) (step 55). If $T_{OUT}>T_{WTO}$, it is determined that the air-fuel ratio should be open-loop controlled to set a flag $F_{WOT}$ to 1 (step 56). The program then proceeds to step 53 where the present feedback correction factor $K_{02}$ is set to 1.0. If $T_{OUT}\leqq T_{WOTO}$, a time $t_{WOTDLYO}$ (0.5 sec, for example) is set in the timer A, and a time $t_{WOTDLY1}$ (10 sec, for example) is set in the timer B (however, the former is shorter than the latter), then starting downcounting in each timer (step 57). The flag $F_{WOT}$ is then reset to 0 (step 58), and it is determined whether or not the operating condition satisfies the other air-fuel ratio feedback control conditions (step 59). If the operating condition requires openloop control such as fuel cutting, the program proceeds to step 53. If the other air-fuel ratio feedback control conditions are satisfied, the air-fuel ratio feedback correction factor $K_{02}$ is calculated (step 60). In calculating the air-fuel ratio feedback correction factor $K_{02}$, an air-fuel ratio is determined from the information of the oxygen concentration $O_2$ in the exhaust gas, for example, and if the air-fuel ratio is richer than the theoretical air-fuel ratio, a predetermined value I is subtracted from the correction factor $K_{02}$, while if the air-fuel ratio is leaner than the theoretical air-fuel ratio, the predetermined value I is added to the correction factor $K_{02}$.

Figure 4:
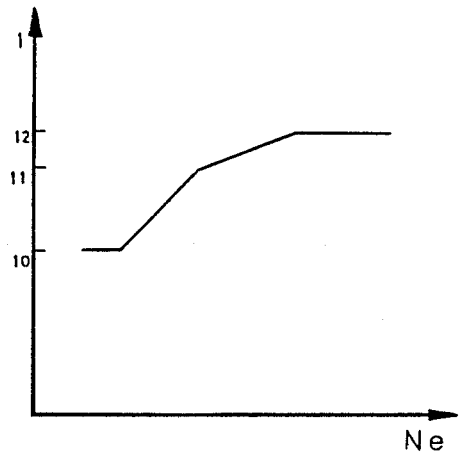
FIG. 4 is a graph of the $N_e$- $T_{WOT1}$ characteristic.
Figure 5:
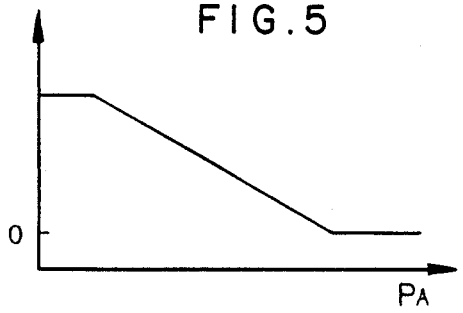
FIG. 5 is a graph of the $P_A$- $\Delta T_{WOTPA}$ characteristic.

If $\theta_{th}\leqq W_{OTO}$ in step 54, the engine speed $N_e$ is read, and a reference value $T_{WOT1}$ corresponding to the engine speed $N_e$ is retrieved from a $T_{WOT1}$ data map (step 61). Further, the atmospheric pressure $P_A$ is read, and a correction value $\Delta T_{WOTPA}$ corresponding to the atmospheric pressure $P_A$ is retrieved from a $\Delta T_{WOTPA}$ data map (step 62). The ROM 30 preliminarily stores the $T_{WOT1}$ data map having a $N_e-T_{WOT1}$ characteristic as shown in FIG. 4 and the $\Delta T_{WOTPA}$ data map having a $P_A-T_{WOTPA}$ characteristic as shown in FIG. 5. Therefore, the CPU 29 retrieves the reference value TWOT1 corresponding to the read engine speed $N_e$ from the $\Delta T_{WOT1}$ data map, and also retrieves the correction value $\Delta T_{WOTPA}$ corresponding to the read atmospheric pressure $P_A$ from the $\Delta T_{WOTPA}$ data map. Referring to FIG. 4, the values of $T_{WOT10}$, $T_{WOT11}$ and $T_{WOT12}$ are 5 msec, 7 msec and 8.5 msec, respectively, for example. The correction value $\Delta T_{WOTPA}$ is then subtracted from the reference value $T_{WOT1}$ retrieved to thereby correct the reference value $T_{WOT1}$ according to the atmospheric pressure (step 63). Further, in the case of AT (automatic transmission) vehicles, a predetermined value $\Delta T_{WOTAT}$ is added to the reference value $T_{WOT1}$ to further correct the reference value $T_{WOT1}$. It is then determined whether or not the fuel injection time $T_{OUT}$ in the previous processing cycle is greater than the corrected reference value $T_{WOT1}$ (step 64). If $T_{OUT} \leqq T_{WOT1}$, the program proceeds to step 57. On the other hand, if $T_{OUT} > T_{WOT1}$, the cooling water temperature $T_W$ is read, and it is determined whether or not the cooling water temperature $T_W$ as read is smaller than a cold engine determination temperature $T_{WO}$ (65° C., for example) (Step 65). If $T_W < T_{WO}$, it is determined that engine temperature is low, and it is then determined whether or not a count value $T_{WOTDLYO}$ of the timer A has reached 0 (step 66). If $T_{WOTDLYO} > 0$, it is determined that the condition of $T_{OUT} > T_{WOT1}$ has not continued for the time $t_{WOTDLYO}$, and if the other air-fuel ratio feedback control conditions are satisfied, the program proceeds to step 58 so as to carry out feedback control. On the other hand, if $T_{WOTDLYO} = 0$, it is determined that the condition of $T_{OUT} > T_{WOT1}$ has continued for at least the time $t_{WOTDLYO}$. Therefore, it is determined that open-loop control should be carried out to make the program proceed to step 56.

If $T_W \geqq T_{WO}$ in step 65, it is determined that the engine temperature is high, and it is then determined whether or not a count value $T_{WOTDLY1}$ of the timer B has reached 0 (step 67). If $T_{WOTDLY1} > 0$, it is determined that the condition of $T_{OUT} > T_{WOT1}$ has not continued for the time $t_{WOTDLY1}$, and if the other airfuel ratio feedback control conditions are satisfied, the program proceeds to step 58 so as to carry out feedback control. On the other hand, if $T_{WOTDLY1} = 0$, it is determined that the condition of $T_{OUT} > TWOT1$ has continued for at least the time $t_{WOTDLY1}$. Therefore it is determined that open-loop control should be carried out to make the program proceed to step 56.

Accordingly, when $\theta_{th} > \theta_{WOTO}$ is effective to indicate a high load condition of the engine as compared with $\theta_{th} \leqq \theta_{WOTO}$, the reference value of the fuel injection time $T_{OUT}$ is set to $T_{WOTO} < TWOT1$.

Further, when $T_W < T_{WO}$ is effective to indicate a low temperature of the engine, and if the condition of $T_{OUT} > TWOT_1$ has continued for the reference time $t_{WOTDLO}$ or more during the air-fuel ratio feedback control, the air-fuel ratio control system executes an air-fuel ratio open-loop control. On the other hand, when $T_W \geqq T_{WO}$ is effective to indicate a high temperature of the engine, and if the condition of $T_{OUT} > T_{WOT1}$ has continued for the reference time $t_{WOTDLY1}$ greater than the reference time $t_{WOTDLY0}$, or more during the air-fuel ratio feedback control, the air-fuel ratio control system executes an air-fuel ratio open-loop control. Accordingly,.when the engine temperature is low, the air-fuel ratio feedback control is shifted to the open-loop control a short time after $T_{OUT} > T_{WOT1}$ has become effective.

Further, the flag $F_{WOT}$ is reset to 0 when an ignition switch is turned on, for example. When the flag $F_{WOT}$ is equal to 1, the fuel increase correction factor $K_{WOT}$ is set to a value greater than 1, thereby enriching the air-fuel ratio.

Further, the predetermined opening $\theta_{WOTO}$ and the time $t_{WOTDLY1}$ are set to different values for AT (automatic transmission) vehicles and MT (manual transmission) vehicles, respectively.

Although the magnitude of engine load is determined according to the throttle valve opening $\theta_{th}$ to differ the reference value in the above preferred embodiment, it may be determined according to the other engine operation parameters such as engine speed.

As described above, according to the fuel supply quantity control method of the present invention, a delay time from a timing when a fuel supply quantity during the air-fuel ratio feedback control has become greater than a reference quantity to a timing when the open-loop control is to be carried out is varied according to engine temperature. Accordingly, at a low engine temperature, the delay time is set to be smaller than at a high engine temperature, thereby quickly enriching the air-fuel ratio and improving the accelerability.

What is claimed is:

1. In a method of controlling a fuel supply quantity with use of a fuel supply device in an internal combustion engine having an exhaust gas component concentration sensor for generating an exhaust gas component signal, the improvement comprising the steps of (a) setting the fuel supply quantity according to engine operation parameters including said exhaust gas component signal so far as a preset fuel supply quantity is not grater than a reference quantity;

(b) setting the fuel supply quantity irrespective of said exhaust gas component signal when said preset fuel supply quantity continues to be greater than said reference quantity for at least a reference time; and (c) changing said reference time according to engine temperature.

2. The improvement as claimed in claim 1, wherein said fuel supply device comprises a fuel injection supply device, further comprising the step of determining whether or not a preset fuel injection time corresponding to said preset fuel supply quantity is greater than a reference value corresponding to said reference quantity.

3. The improvement as claimed in claim 1, wherein said reference time is set to be short when said engine temperature is low.

* * * * *